United States Patent [19]

Supkis

[11] 3,997,302

[45] Dec. 14, 1976

[54] COATED ABRASIVE PRODUCTS HAVING A SUPERSIZE LAYER OF A CONJUGATED DIOLEFIN POLYMER

[75] Inventor: Stanley J. Supkis, Averill Park, N.Y.

[73] Assignee: Norton Company, Worcester, Mass.

[22] Filed: May 27, 1975

[21] Appl. No.: 580,671

Related U.S. Application Data

[63] Continuation-in-part of Ser. No. 141,666, May 10, 1971, abandoned, which is a continuation-in-part of Ser. No. 47,786, June 19, 1970, abandoned.

[52] U.S. Cl. ..... 51/295; 51/298 A; 51/299 A

[51] Int. Cl.[2] ..... B24D 11/00

[58] Field of Search ..... 51/295, 298, 299

[56] References Cited

UNITED STATES PATENTS

| | | | |
|---|---|---|---|
| 3,232,729 | 2/1966 | Holland et al. | 51/298 |
| 3,331,667 | 7/1967 | Schnabel | 51/298 |
| 3,541,739 | 11/1970 | Bryon et al. | 51/298 |
| 3,619,150 | 11/1971 | Rinker et al. | 51/298 |

*Primary Examiner*—Donald J. Arnold
*Attorney, Agent, or Firm*—Oliver W. Hayes

[57] ABSTRACT

Coated abrasive material is provided having a supersize layer thereon which improves grinding. This layer comprises an elastomeric material having substantial residual unsaturation and an active solid, particulate grinding aid.

4 Claims, 1 Drawing Figure

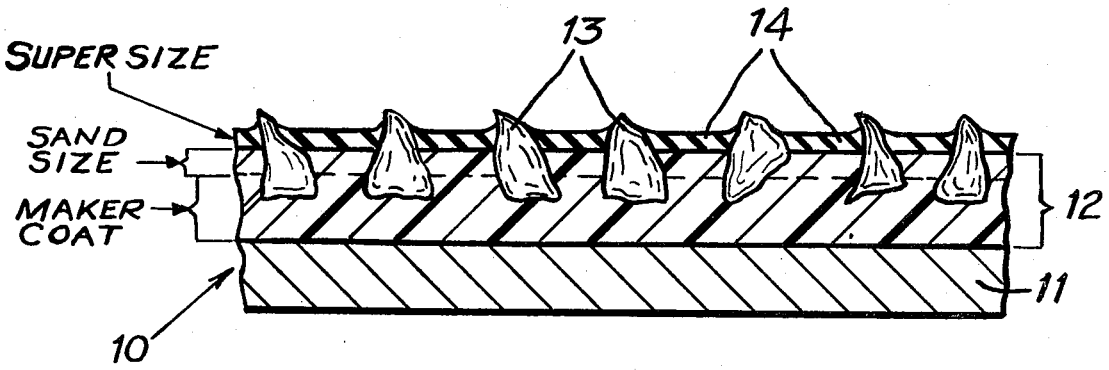
SUPER SIZE
SAND SIZE
MAKER COAT
13
14
12
11
10

COATED ABRASIVE PRODUCTS HAVING A SUPERSIZE LAYER OF A CONJUGATED DIOLEFIN POLYMER

CROSS-REFERENCE TO RELATED APPLICATION

This application is a continuation-in-part of copending application Ser. No. 141,666 filed May 10, 1971 which was a continuation-in-part of application Ser. No. 47,786 filed June 19, 1970, both now abandoned.

BACKGROUND OF THE INVENTION

This invention relates to new improved coated abrasive material. Coated abrasive material, which has been manufactured for many years and is commonly referred to as "sandpaper", is in general made by continuously applying to a suitable, relatively wide backing member, a first coat of an adhesive composition, referred to in the art as a "making" coat, followed by the immediate application of abrasive grains. The making coat is solidified to hold the grains on the backing member, after which, in most instances, an adhesive composition referred to as a "sand sizing" coat is applied and solidified. These coats constitute the bond for the abrasive grains, substantially all of which are bonded to the backing member only at their base so that they extend outwardly therefrom in cantilever fashion in random heights and spacings. After further cure of the adhesive bond, the coated abrasive material thus prepared is then processed into forms more suitable for use such as sheets, rolls, belts and discs.

The use of coated abrasive articles is occasioned, in general, with a relatively high initial rate of cut. However, during use, for various reasons, the rate of cut decreases and when it falls to a rate below economic usefulness the coated abrasive article is discarded.

Heretofore others have suggested incorporating a so-called "grinding aid" in the nature of an active filler in a coated abrasive product.

In recently issued U.S. Pat. No. 3,541,739 (Bryon et al) there is disclosed an active filler in at least the outermost layer which may be, for example, the supersize layer, which comprises, in addition to the filler, the usual coated abrasie bond material (e.g. resole phenolic resin) as a binder. Although other fillers may be included in such a composition, the most critical filler is disclosed to be a simple or complex metal halide, the latter being represented by, e.g., sodium fluoaluminate, i.e., cryolite, and potassium fluoborate (potassium borofluoride).

What one might term another species of "grinding aid" is disclosed in U.S. Pat. No. 3,256,076 (Duwell et al). The patentee therein discloses applying to the surface of a coated abrasive sheet material, as a supersize layer, a filmforming material which comprises an organic compound containing a chemically bound substituent which decomposes at the grinding temperature and which, in the presence of normal room humidity, is rapidly reactive with or corrosive to the metal being abraded. The chemically bound constituent is chlorine, bromine or divalent sulfur which on decomposition yields HCl, HBr, or $H_2S$. Such a reaction, according to the patentee, is indicated by a reduction in friction between the abrasive granules and the metal surface being abraded. One may conclude, it is believed, that this Duwell invention inhibits glazing by lowering the frictional forces in grinding thus lowering the grinding temperature.

U.S. Pat. No. 3,619,150 (Rinder et al) discloses a nonloading top coating for sandpaper particularly suited for sanding wood or painted surfaces. This coating consists of a metallic soap (e.g. zinc stearate) dispersed in a resin composition containing a mixture of a thermosetting resin and an elastomeric resin. The top coating does not contain an "active filler" grinding aid.

U.S. Pat. No. 3,232,729 (Holland et al) discloses a size coating (as distinguished from a supersize coating) containing a mineral filler (e.g. cryolite) on a sandpaper having a making coat of glue, hexanetriol and synthetic rubber latex (e.g. butadiene-styrene). The size coating can be made with animal glue or a thermosetting resin.

U.S. Pat. No. 3,331,667 (Schnabel) describes a maker coat and a size coat of a mixture of animal glue and a latex dispersion of a carboxylated styrene butadiene polymer. It contains no "active filler" grinding aid and this product seems to be primarily useful in the wood working industry.

SUMMARY OF THE INVENTION

This invention involves, in its basic aspects, the provision at the exposed surface of a coated abrasive material of a supersize layer comprising an elastomeric material which in addition to supporting an active, solid, particulate filler material, also acts by itself to improve grinding.

Elastomeric materials which have been found to function in a dual manner, i.e. as a binder material as well as a grinding aid per se, are, in general, polymeric materials of monomers which, when polymerized, result in substantial residual unsaturation.

A grinding aid layer, as is provided by my invention, has been discovered to result in, in certain grinding applications, a noticeable reduction in frictional heat. (In grinding of titanium a noticeable reduction of sparking is achieved). This is accompanied with a cooler cutting action which provides less potential for glazing over of the coated abrasive material thereby resulting in extended product life as well as more uniform cut over the life of the abrasive product.

The coated abrasive material of this invention may be used to advantage in various dry grinding applications; however, it will be found particularly useful in light pressure operations, e.g. those involving off-hand sanding. These grinding operations include, among other things, the dry grinding of brazed welds and workpieces of hard to grind metals such as stainless steels and titanium. The ever increasing use of titanium metal in fabrication of various articles, e.g., in the aircraft industry, has made the need for a solution to safer, better, and faster grinding of this metal acute.

A theoretical mechanism is postulated for the improvement brought about by the unsaturated elastomeric material used in the top size of the present invention. It apparently decomposes at the grinding temperature through a free radical mechanism and the available free radicals apparently catalyze the oxidation of the metal being ground.

Regardless of the mechanism occurring, however, abrasive material of this invention can be used to advantage and will be found to improve cutting efficiency considerably.

BRIEF DESCRIPTION OF THE DRAWING

The invention is described hereinafter in greater detail by reference to the drawing which consists of a sole figure showing, greatly enlarged, a view in cross-section of a portion of a coated abrasive material according to the invention. It should be understood, however, that the drawing, as well as the examples hereinafter given, are for purposes of illustration only and that the invention in its broader aspects is not limited thereto.

DETAILED DESCRIPTION OF THE INVENTION

Referring now to the drawing, there is disclosed coated abrasive material 10 comprising a backing member 11, a bond 12, and abrasive grain 13. On top of bond 12 is a layer 14 with which my invention is more particularly concerned. Such a layer is traditionally referred to in the coated abrasive industry as a supersize layer or coat, and in many instances as merely a "supersize".

Backing member 11 can be of, e.g., paper, cloth or a laminate of paper plies, cloth plies, or a combination of paper and cloth plies, vulcanized fiber, or other flexible strong material, all of which are used customarily in the manufacture of coated abrasive material. The backing member can be filled, if cloth, with any desired filling materials these being well-known in the abrasive industry. Moreover, it can be further provided with front and backsize materials as desired, these also being conventionally used.

Bond 12, which secures abrasive grain 13 to the backing member, may be any of the thermosetting resinous materials used conventionally in the manufacture of coated abrasives, e.g., the phenolics, alkyds, expoxies, ureaformaldehyde, and the like. The bond can be solely a maker coat or it can include a size coat as well. Where a size coat is provided it may be of the same material as the maker coat or of different material, as desired. The manner of application of the material for the bond will, of course, depend somewhat on the particular material chosen; however, the means for and manner of application of these bonding materials are well known in the abrasive art. As is believed obvious, the material used for the bond will depend on the particular properties desired in the ultimate coated abrasive product. Merely by way of example, I have found that particularly good results are obtained in the practice of the invention where both the maker and size coats are of phenolformaldehyde.

Abrasive grains with which one will obtain improved results with this invention include silicon carbide, alumina, and polycrystalline abrasive grain of, e.g., fused zirconiaalumina, all of which are conventionally used in the manufacture of coated abrasive material. The size grain used depends somewhat on the particular application. Particularly good results will be obtained with medium and coarse grit grain.

A preferred abrasive material used in the practice of my invention comprises a conventional cotton cloth backing member having a resin maker and sand size coat and including either silicon carbide or aluminum oxide abrasive grain. These coated abrasive materials are well known and their manner of manufacture per se forms no part of this invention.

Supersize layer 14, with which this invention is basically concerned, is an elastomeric material which, quite unexpectedly it is believed, functions not only as a binder for active fillers but actively aids in increasing the cutting ability of coated abrasive material. Importantly, in addition to these features, the elastomeric material is characterized by its good adhesion to the thermoset resins which are conventionally used as a coated abrasive bond and its physical properties which permit it to desirably soften during grinding without blistering. These properties are desirable in that they prevent undesirable flake-off of the supersize layer during usage and provide that it will be available to perform its intended function during the life of the coated abrasive material. Thus, in the most preferred embodiment of the invention, the supersize layer comprises an elastomeric material which functions not only as a binder by means of which particulate grinding aid material, as hereinafter further described, may be incorporated in the supersize layer but as a grinding aid, in and of itself.

Materials which are capable of performing such a dual function, i.e., function as a grinding aid as well as a binder for particulate grinding aids, I have discovered, are polymers having substantial residual unsaturation. By this is meant a degree of unsaturation that is indicated by a weight percent of $c=c$ functional groups of at least 10% or by an iodine number of at least 105. One class of such polymers includes polymeric materials of conjugated diene monomers, e.g., butadiene and its homologues. The invention, however, it is not limited solely to homopolymers of these monomers and, in its preferred aspects, includes copolymers thereof with, for example, monomers copolymerizable therewith such as acrylonitrile and styrene. Other polymeric materials of this class and which can be desirably used in the practice of the invention are carboxylated butadiene-acrylonitrile and carboxylated butadiene-styrene copolymers. Where, however, a copolymer is utilized in the practice of the invention, the copolymer must contain no less than about 50% by weight (total) of the conjugated diolefin. Such a copolymer containing butadiene-styrene may have substantial unsaturation as represented by an iodine number of, e.g. about 160.

Polymeric materials, as above disclosed, are readily available commercially. Carboxylated copolymers which have been found suitable as a grinding aid per se and as a binder for particulate grinding aids are available from Standard Brands Chemical Industries, Inc. (formerly International Latex Corporation) in the form of a nonionically stabilized latex (40% by weight solids) under the trade designation TYLAC. These latices and their manner of manufacture are believed disclosed in U.S. Pat. Nos. 2,961,348; 3,256,234; and 3,422,050, the disclosures of which are herein incorporated by reference. As disclosed in these patents, carboxylation occurs through introduction of an ethylenically unsaturated monocarboxylic acid, e.g. acrylic and methacrylic acid, or a partial ester of unsaturated polybasic acids, e.g. itaconic, fumaric, and maleic acid, into the polymeric chain.

One carboxylated copolymer found particularly suitable in the practice of my invention is identified by the trade designation TYLAC 3502A and is believed to comprise (by weight dry monomer solids) about 17% acrylonitrile and from about 1–3% carboxylic acid, the remainder being substantially butadiene. This copolymer has a weight percent of $c=c$ functional groups of about 38%. Another suitable copolymer is available under the trade designation TYLAC 4485C and is believed to comprise, on a monomer total weight basis, about 56% butadiene, about 41% styrene, and about 3% carboxylic acid. It has a weight percent of $c=c$ functional groups of about 24%.

These polymeric materials and latices thereof are deemed well-known in the coating art and require no detailed explanation herein. As is usual, these latices, in addition to their major components, may include conventional additives such as antioxidants, and wetting and stabilizing agents. The latter agent is necessary to prevent the latex solids from salting out on adding an active particulate filler as hereinafter described. Such additive components, as will provide an optimum coating composition, are deemed well-known in the coating art and require no further explanation herein. However, it should be pointed out that, in general, a larger amount of a stabilizing agent is required in latices used herein where an active filler is also used than is used in other applications involving use of these latices. Satisfactory results will be obtained where, in general, the amount of stabilizing agent is from about 3–12% by weight (dry) of the latex solids.

Those fillers which may be satisfactorily used in the invention are the metal fluorides, in particular, the complex alkali metal fluorides. Suitable such fluorides include, e.g. sodium aluminum hexafluoride, potassium aluminum hexafluoride, sodium silicofluoride, sodium fluoborate, potassium silicofluoride, and potassium fluoborate. Other known active fillers, however, may be used in place of those above-mentioned, and in some instances to good advantage in combination therewith. These other fillers include, but are not deemed limited to, active fillers such as simple metal halides, e.g. calcium fluoride, aluminum fluoride, sodium fluoride, and potassium fluoride. The weight of active filler should not be greater than about 60% by weight (dry basis) of the total supersize layer composition. Lesser amounts of elastomeric binder in the supersize layer presents problems in coating such a supersize composition and, most disadvantageously, results in inadequate adhesion between the particles of active filler and of the supersize layer with the coated abrasive bond. The preferred composition is from about 30–50% by weight, the higher weight of active filler being even more preferred, this weight being based upon the total weight (dry basis) of grinding aid and elastomeric material.

In the practice of my invention, the manner of providing layer 14 on the coated abrasive material may depend somewhat on the particular polymeric material chosen. However, any of the usual means for application of a coating composition, e.g. roll coating, spray coating, air knife, etc. will be found satisfactory. Where the supersize layer is to be deposited from a latex composition as above-described, which formulation also includes an active filler, the latex composition for application to the coated abrasive material will preferably comprise about 50% or more total solids. When such a latex composition is roll coated, according to usual techniques and doctored with, e.g., an air knife, a uniform appearing supersize layer will result. With a lesser solids content application by roll coating is possible, however, one may obtain on drying a layer having a mottled or non-uniform appearance. Even so, when the same amounts of composition are applied, the results in grinding are comparable. The active filler most preferred is a complex sodium fluoride, such being soluble in the aqueous vehicle for the polymeric binder whereby, on application and subsequent drying, the active filler will be well dispersed throughout layer 14.

The amount of latex composition applied to the coated abrasive material, as is deemed obvious, will of course depend on a number of factors e.g. size of abrasive grain, spacing of the grain, solids content, etc. The main consideration to keep in mind is that, in general, it is desirable to apply a sufficient quantity of latex composition so that on drying and during use of the coated abrasive material the supersize layer will be as closely adjacent the surface of the metal being ground as possible. As seen in the drawing the tips of the abrasive grain remain substantially uncoated. It is in general undesirable that the abrasive grains be entirely covered over. This generally leads to merely smearing the layer 14 on the surface to be ground thus resulting in relatively little, if any, cut. The tips of the abrasive grain in the resulting coated abrasive product must at least be exposed at the start of the grinding operation. Where layer 14 covers over the abrasive grain tips, these products will be found unsuitable in off-hand grinding operations; however, where higher pressures are encountered, e.g. mechanical automatic grinding, the fact that the abrasive grain tips are covered over initially is of less consequence. Generally speaking, however, in coarser grade abrasive products a greater amount of supersize is deposited on the surface than with finer grades. However, the optimum amount of latex composition to be applied as well as the exact solids formulation thereof for any particular grinding application is best determined by a few simple experiments in the laboratory.

Subsequent to application to the coated abrasive material, the latex composition is dried to remove the water therefrom and to bring about film forming ("fusion") of the particulated carboxylated copolymer. The drying time required, depends, of course, on factors such as temperature, amount of water present in the latex composition, and the like. However, merely by way of example, satisfactory drying can be accomplished, in general, by heating with air at 100° F for about 30 minutes. Afterwards, the dried deposit is "fused" by heating at 225° F for at least 10 minutes. Obviously, drying and film forming can be accomplished at other time-temperature relationships, even at room temperature, however, this takes much longer.

The thus manufactured coated abrasive material is then further processed in accordance with usual techniques into forms more suitable for use in grinding operations such as sheets, rolls, belts and discs.

The following specific examples will illustrate more clearly the preferred embodiments of my invention.

EXAMPLE 1

A conventionally produced coated silicon carbide abrasive sheet material (20 inches wide) (identified by the trade designation 60X-R/R DURITE OPENKOTE) was coated on the abrasive surface with a supersize composition prepared as follows:

A supersize composition was prepared by adding to a latex composition a suitable amount of sodium fluoborate to provide a 1:1 ratio (by weight) sodium fluoborate to latex solids and to provide a 50% total solids content. The latex is available commercially from Standard Brands Chemical Industries, Inc. of Dover, Delaware under the trade designation TYLAC 3502A, and has a weight percent of $c=c$ functional groups of about 38%. The thus prepared composition was applied at room temperature, e.g. 75° F, to the abrasive surface by passing the above coated abrasive material (10.5 fpm) over a partially submerged coating roll (6 inches diameter) rotating in a vessel containing the above composition. After application the coating composition was made smooth and uniformly thick and excess composition was removed by means of a conventional air knife operated at a pressure of 16.6 inches (water) utilizing compressed air at room temperature. The orifice of the air knife was set at an opening of 28 mils and was spaced at a distance of about ¾ inch from the coated surface. It was directed at an angle of 45° with respect to the coated web and against the direction of movement thereof.

A sufficient amount of the latex composition was provided on the front surface of the coated abrasive web to provide, on subsequent drying and curing, a weight of 7.4 lbs. per sandpaper maker's ream of 480 sheets, 9 inches × 11 inches. The wet coating was air dried for 30 minutes at room temperature (100° F) after which it was heated for 10 minutes at 225° F to fuse the latex solids. On fusion, a layer of rubbery elastomeric material results.

As mentioned previously, the tips of the abrasive grains, on examination of the coated abrasive material, must be exposed sufficiently to be noticeable visually or when running one's fingers over the abrasive surface.

An endless abrasive belt (2-½ inches × 60 inches) was manufactured from the thus coated abrasive material according to usual belt-making techniques. Grinding tests were then run on the abrasive belt under controlled conditions. The test performed is that conventionally known as a "backstand belt test" wherein, in general, a belt of the above indicated size, positioned horizontally, is moved inwardly at a constant pressure and in a direction substantially normal against the ½ inch face of a workpiece (½ inch × 2 inches × 9-¾ inches) moving back and forth over a distance of 9-¾ inches at 7 feet per minute. The grinding machine used has the capability of providing a variable belt speed of from 0 SFPM to 6750 SFPM (surface feet per minute). A 55 durometer, rubber, vertically disposed, serrated contact wheel (7 inches diameter) was used. The experimental belt and a control belt (60X-R/R DURITE) were evaluated in the same manner on a titanium workpiece at a belt speed of 5500 SFPM. The applied load on the metal being ground was 15 lb. dead weight. The results obtained are given below.

| Belt | Time (Min.) | Cut in Grams |
|---|---|---|
| 60X Control | 8 | 14* |
| 60X + supersize of TYLAC® 3502A and | 8 | 25 |
| Fluoroborate | 14 | 38 |

*burning of workpiece - had to stop.

The supersize layer resulted in not only improved cut but was discovered to have good adhesion with the cured phenol-formaldehyde resin in the size coat commercial 60X-R/R DURITE as evidenced by no flaking-off of the supersize layer during belt usage.

On examination of the workpiece, the surface finish was seen to be finer than is usually provided with such abrasive grit. Thus, in certain instances, it may be possible to omit further finishing operations normally performed on such metals.

EXAMPLE 2

A coated abrasive belt was prepared as in Example 1 except that the coated abrasive material was 60X-R/R METALITE abrasive cloth. This abrasive cloth has aluminum oxide abrasive grain rather than silicon carbide. The performance of this abrasive belt was evaluated as before except on 304 stainless steel and was compared with a commercially available belt. This commercial belt was 60X-R/R and had in its outermost layer a resinous bond carrying an inorganic fluoride, believed to be sodium silicofluoride. This belt was sold by English Abrasives Limited of England, under the designation HiTest. It is believed to have been made under British Pat. No. 1,145,082. Over a 14-minute time period (5500 SFPM, 15 lb. dead weight), the cumulative cut of the belt according to our invention was 346 grams. On the other hand, the competitive belt in the same period of time cut only 239 grams.

EXAMPLE 3

Other abrasive belts were prepared as in Examples 1 and 2 except that in one such belt the abrasive grain was finer (80 grit $Al_2O_3$), and in the other belt a 30% solids composition (30% sodium fluoborate) was applied to the abrasive surface (60 grit $Al_2O_3$).

On evaluation as in Example 2 on grinding the same 304 stainless steel the 80 grit belt cut 270 grams while the 60 grit belt cut 274 grams. Thus it is seen that on comparison with the commercially available belt a greater amount of metal is removed in a belt according to my invention, even with a lesser amount of active filler in the supersize layer or with finer abrasive grain, than with the competitive belt.

EXAMPLE 4

Three abrasive belts were made by supersizing a commercial 80 grit alumina sandpaper sold by Norton Company under the designation 80X-R/R RESINALL METALITE, Type 8, this having a phenolic makercoat and a phenolic size coat. One sample contained a supersize of TYLAC 3502A with no filler, the TYLAC being applied in a sufficient weight so that the tips of the grains were just visible. The second sample was similarly supersized with a mixture of TYLAC 3502A and $KBF_4$ (50% by weight solids). The third sample was similarly supersized with a mixture of resole phenolic resins containing 50% by weight of $KBF_4$. These samples were then tested against the unsupersized 80X-R/R as a control with the results shown in the following table:

| | Rate of Cut in Grams/Min. As A Function Of Time | | | | | | |
|---|---|---|---|---|---|---|---|
| Belt | 1 Min. | 3.0 Min. | 5 Min. | 7 Min. | 9 Min. | 11 Min. | 13 Min. |
| Control | 21 | 10.5 | 7.5 | 6 | 5 | 4 | 3.5 |
| TYLAC® | 23 | 15.5 | 10 | 7 | 5.5 | 5 | 4 |
| TYLAC® + $KBF_4$ | 17.5 | 26 | 27.5 | 22.5 | 17 | 14 | 10 |
| Phenol + $KBF_4$ | 20 | 23.0 | 17.5 | 14 | 11 | 8.5 | 7.5 |

From the results of Example 4 it is apparent that the TYLAC alone gives some improvement in grind over the unsupersized product. Similarly the $KBF_4$ in the phenolic supersize (U.S. Pat. No. 3,541,739) gives substantial improvement over the control. However, at times of 5 min. and more, the aggregate improvement of the TYLAC alone and the $KBF_4$ + phenolic is much less than the synergistic results of TYLAC + $KBF_4$ and this improved rate of cut continues for the life of the belt.

EXAMPLE 5

A 2 inches × 132 inches belt was prepared from coated abrasive material having a supersize composition as disclosed in Example 1. The coated abrasive material used is commercially available from Norton Company under the trade designation 50X RESINALL CLOSEKOTE METALITE abrasive cloth. By such designation is intended a coated abrasive material having grit 50 $Al_2O_3$ abrasive grain, closely coated on a phenol-formaldehyde maker adhesive and provided with such an adhesive material as a resinous size coat.

The thus prepared abrasive belt was evaluated against another commercially available competitive belt of comparable abrasive material but with a different supersize layer thereon. This competitive belt was obtained from English Abrasives Limited (EAC) and was sold under their designation HiTest. This EAC belt was believed to contain a supersize layer and appeared to be made in accordance with the teachings of U.S. Pat. No. 3,541,739. These two belts were tested on 1704 stainless steel. This evaluation was performed on a Hammond polishing lathe with a power pack unit modified to provide a constant 40 p.s.i. on the workpiece during the grinding operation. Such apparatus has a 70 durometer, serrated contact wheel.

Over the critical initial 5-minute period of grinding, the abrasive belt according to my invention out-performed the competitive EAC belt. The total cut resulting from my belt was 230.0 grams; however, only 208.2 grams stock was removed by the competitive belt. Moreover, the competitive EAC belt "died out" much earlier than did the belt of my invention.

In the preceding discussion of the invention, considerable emphasis has been placed on the degree of unsaturation of the elastomeric adhesive used in the supersize coating. The general insolubility of high molecular-weight, emulsion-polymerized, styrene/-butadiene and butadiene/acrylonitrile copolymers is a deterent to conventional analysis for carbon-carbon double-bond unsaturation (such as the "iodine value"). However, the same insolubility is turned to advantage in the analysis described herein. A low-boiling solvent (e.g. dichloromethane) is used to swell these polymerized latex films, remove additives for purification, and act as a transfer medium for bromination. Results have been close to both theoretically calculated values, and to answers obtained from an independent laboratory. This analysis defines the amount of unsaturation, in a film, in terms of weight percent $c = c$ functional groups, taken to have a molecular weight of 24 grams/mole.

The following analytical technique was employed:

EXAMPLE 6

Each type of latex, as received was brushed into a flat surface and cured. One-inch square sections of latex film are cut out and weighed. As each film is weighed, it is transferred to a beaker containing the $CH_2Cl_2$. It appears useful not to weigh the latex film in the beaker directly, since its surface tack causes some adhesion problems with the glass walls or bottom of the beaker. The films will be observed to float, and typically increase 10–20 fold in volume as swelling takes place. Two hours of swelling/extraction appear to have been sufficient.

After swelling, the $CH_2$ $Cl_2$ in the beakers is withdrawn by suction. This step must be done carefully to avoid damaging the fragile swollen film.

A freshly-prepared bromine solution in $CH_2Cl_2$ (~1% by wt.) is decanted gently into the beakers, and bromination allowed to take place at room temperature for an hour (found to be sufficient). During this time, the swollen latex films will be observed to sink as their densities increase by bromination.

The extraction-$CH_2Cl_2$ is decanted from the suction flask, evaporated and weighed to determine the amount of material lost from the latex film, and therefore the "extracted" film weight before bromination.

After bromination, the bromine-containing $CH_2Cl_2$ is "suctioned-off" and discarded. Three $CH_2Cl_2$ rinses were decanted into the beakers, and also discarded after suction recovery. The beakers, with brominated films, are dried in an oven at 45° C for 1-½ hours and weighed after equilibration with the room. The weight of these films minus the "extracted" film weight determines the weight gain caused by bromination.

The results of a number of tests run on film of TYLAC 4485C (styrene butadiene) and TYLAC 3502A (butadiene acrylonitrile) and given in the following table:

| Latex Copolymer Film | Cure Temp./ Cure Time | Film Thickness | Extraction/Swelling Time | Bromination Time | Wt.% Film Remain. | Wt.% c = c |
|---|---|---|---|---|---|---|
| 4485C | room/overnight | ~0.1mm | 17 hrs. | 2 hrs. | 73. | 23. |
| 4485C | 50° C/5 hours | ~0.4mm | 2 hrs. | 1 hr. | 74.5 | 24. |
| 4485C | room/overnight | ~0.1mm | 2 hrs. | 1 hr. | 80. | 24. |
| 3502A | room/overnight | ~0.1mm | 17 hrs. | 2 hrs. | 75. | 37. |
| 3502A | 50° C/5 hours | ~0.7mm | 2 hrs. | 1 hr. | 80. | 39. |
| 3502A | room/overnight | ~0.7mm | 2 hrs. | 1 hr. | 80. | 38. |

In the above procedure the swollen film can be envisaged as a connected polymer network enormously "opened-up" by the solvent and permeable to it. This permeability means that, for thin film, the degree of bromination will not be appreciably diffusion controlled.

For both types of latex films considered here, bromine, a heavy liquid, adds rapidly and quantitatively to carbon-carbon double bonds:

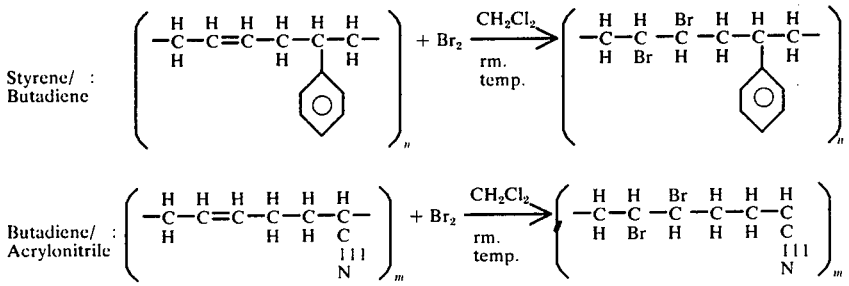

(Note: Only simple, nominal polymer forms are shown, not branched or cross-linked structures, which also can and probably do exist.)

Since the number of carbon-carbon double-bond functional groups ($c = c$), weighing 24 grams/mole, is detected by a reactant ($Br_2$) weighing 160 grams/mole, then the weight in grams of $c = c$ present is given by:

$$\frac{24}{160} \times \text{wt. gain from bromination,}$$

or the weight percent of $c = c$, present is given by:

$$\frac{24}{160} \times \frac{\text{wt. gain from } Br_2}{\text{wt. extracted film}} \times 100,$$

which reduces to:

$$\text{wt. \% } c = c = 15 \times \frac{\text{wt. gain}}{\text{wt. extracted film}}$$

While the above procedure does not give an "iodine number" or "iodine value", the approximate relationship appears to be: Iodine value $\cong$ (wt. % $c = c$) $\times$ 10.

As many different embodiments of our invention will occur to those skilled in the coated abrasive art, it is to be understood that the specific embodiments of the invention as presented herein are intended by way of illustration only and not limiting upon the invention, but that the limitations thereon are to be determined only from the appended claims.

What is claimed is:

1. In a coated abrasive material comprising a flexible backing member, an adhesive bond, including a sand size layer, and consisting essentially of a thermoset resin on the front surface of said backing member, abrasive grains firmly affixed by the adhesive bond to the backing member, and a supersize layer on the surface of said coated abrasive comprising an adhesive securing a particulate grinding aid on the working surface of the abrasive, the improvement which comprises the use in said supersize layer of an adhesive consisting essentially of an elastomeric material selected from the group consisting of polymers of conjugated diolefins and copolymers of conjugated diolefins with at least one other monomer copolymerizable therewith, said other monomer being less than about 50% by weight of the total weight of the copolymer, said elastomeric material having substantial residual unsaturation, in terms of the weight percent of $c = c$ functional groups, and being active in increasing the cutting ability of the coated abrasive material and being further characterized by having good adhesion to the adhesive bond for the abrasive at the temperatures obtained during use of the abrasive materials.

2. In a coated abrasive material comprising a flexible backing member, an adhesive bond, including a sand size layer, and consisting essentially of a thermoset resin on the front surface of said backing member, abrasive grains firmly affixed by the adhesive bond to the backing member, and a supersize layer on the surface of said coated abrasive comprising an adhesive securing a particulate grinding aid on the working surface of the abrasive, the improvement which comprises the use in said supersize layer of an adhesive consisting essentially of an elastomeric material selected from the group consisting of polymers of conjugated diolefins and copolymers of conjugated diolefins with at least one other monomer copolymerizable therewith, said other monomer being less than about 50% by weight of the total weight of the copolymer, said elastomeric material having substantial residual unsaturation, at least 10 weight percent of $c = c$ functional groups, and being active in increasing the cutting ability of the coated abrasive material and being further characterized by having good adhesion to the adhesive bond for the abrasive at the temperatures obtained during use of the abrasive materials.

3. The product of claim 2 wherein the elastomeric material has at least 20 weight percent of $c = c$ functional groups.

4. The product of claim 2 wherein said elastomeric material is a copolymer of butadiene with a material selected from the group consisting of styrene and acrylonitrile.

* * * * *